US009964104B2

(12) United States Patent
Chou

(10) Patent No.: US 9,964,104 B2
(45) Date of Patent: May 8, 2018

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 231 days.

(21) Appl. No.: 14/874,371

(22) Filed: Oct. 2, 2015

(65) Prior Publication Data

US 2016/0102661 A1 Apr. 14, 2016

(30) Foreign Application Priority Data

Oct. 8, 2014 (TW) ..... 103135093 A

(51) Int. Cl.

| | |
|---|---|
| ***F04B 39/12*** | (2006.01) |
| ***F04B 53/00*** | (2006.01) |
| ***F04B 53/10*** | (2006.01) |
| ***F04B 53/16*** | (2006.01) |
| ***F15B 15/14*** | (2006.01) |
| ***F04B 35/04*** | (2006.01) |
| ***F04B 35/06*** | (2006.01) |
| ***F04B 39/00*** | (2006.01) |
| ***F04B 41/02*** | (2006.01) |

(Continued)

(52) U.S. Cl.

CPC ..... *F04B 39/121* (2013.01); *F04B 35/04* (2013.01); *F04B 35/06* (2013.01); *F04B 39/0027* (2013.01); *F04B 39/0061* (2013.01); *F04B 39/12* (2013.01); *F04B 39/125* (2013.01); *F04B 41/02* (2013.01); *F04B 53/007* (2013.01); *F04B 53/103* (2013.01); *F04B 53/1032* (2013.01); *F04B 53/16* (2013.01); *F15B 15/1428* (2013.01); *F04B 37/12* (2013.01); *F04B 53/14* (2013.01)

(58) Field of Classification Search

CPC .... F04B 39/125; F04B 39/123; F04B 53/007; F04B 53/103; F04B 53/1032; F04B 53/16; F04B 39/14; F04B 39/12; F04B 39/121; F04B 39/127; F04B 53/162; F04B 53/08; F04B 39/06; F04B 39/066; F16J 1/12; F15B 15/1428; Y10T 137/7925; Y10T 137/7929

See application file for complete search history.

(56) References Cited

U.S. PATENT DOCUMENTS 1,516,846 A * 11/1924 Dever ..... F04B 39/1013 137/454.6
3,916,496 A * 11/1975 Freiheit ..... B23P 15/001 29/520

(Continued)

*Primary Examiner* — Bryan Lettman

(57) ABSTRACT

An improved air compressor includes a cylinder with a piston body and an air storage container. The air storage container can be detachably mounted to the cylinder to define a primary air chamber, and an auxiliary air chamber which can reduce the motion resistance of the piston body, so that the piston body can conduct reciprocating motion in the cylinder more smoothly. Furthermore, the cylinder has an open bottom that is divided into two halves according to a central vertical line (Y) of the cylinder, wherein one half of the open bottom is horizontal while the other half of the open bottom is slanted. When the piston body reaches the bottom dead center, the head of the piston body will be entirely within the cylinder and thus keep air-tight with the cylinder. Therefore, the performance of compressing air and the operational safety can be increased.

2 Claims, 6 Drawing Sheets

(51) Int. Cl.
*F04B 37/12* (2006.01)
*F04B 53/14* (2006.01)

(56) References Cited

U.S. PATENT DOCUMENTS

| | | | | |
|---|---|---|---|---|
| 4,385,872 | A * | 5/1983 | Anderson | F04B 39/10 417/566 |
| 2005/0067023 | A1* | 3/2005 | Palvolgyi | F02M 37/0023 137/538 |
| 2007/0065311 | A1* | 3/2007 | Chou | F04B 39/123 417/415 |
| 2012/0121443 | A1* | 5/2012 | Chou | F04B 35/04 417/297 |
| 2013/0287603 | A1* | 10/2013 | Park | F04B 39/023 417/410.1 |
| 2016/0201660 | A1* | 7/2016 | Yang | F16J 10/02 92/162 R |

* cited by examiner

AIR COMPRESSOR

The present invention relates to an improved air compressor and, more particularly, to an air compressor, which claims the Taiwan priority filing date of Oct. 8, 2014 of Application No. 103135093.

(a) TECHNICAL FIELD OF THE INVENTION

The present invention relates to an improved air compressor and, more particularly, to an air compressor, which includes a cylinder fitted with a piston, and an air storage container made separately from the cylinder, wherein the air storage container can be detachably mounted to the cylinder, and the cylinder defines an auxiliary air chamber for storing additional compressed air, so that the piston can conduct reciprocating motion in the cylinder more smoothly.

(b) DESCRIPTION OF THE PRIOR ART

Conventional air compressors generally include a cylinder, an air storage container, a motor, and a transmission mechanism. The air storage container, which has an opening at its top and multiple outlets at its periphery, is formed integrally with the cylinder. An air exit port is provided at the top wall of the cylinder, through which compressed air produced in the cylinder can be transferred to the air storage container. The air exit port provided between the air storage container and the cylinder is sealed by a plug engaged with one end of a compression spring when the air pressure in the cylinder is less than a predetermined pressure. A cap is mounted at the cylinder by bolts for closing the opening of the air storage container. However, the mounting of the compression spring and the plug is difficult, and the compressed air in the air storage container exerts considerable back force on the plug, which may cause the plug difficult movement.

In operation, the motor can drive the transmission mechanism to have a piston body conduct reciprocating motion in the cylinder to produce compressed air in the cylinder, which can be transferred to the air storage container via the air exit port. Through one of the outlets, the compressed air in the air storage container can be transferred to an object to be inflated. However, in conventional air compressors, the top wall of the cylinder generally has the same thickness as the peripheral wall of the air storage container. When the piston body reaches TDC (top dead center), the head of the piston body almost contacts the top wall of the cylinder. Therefore, almost all the compressed air produced in the cylinder will immediately flow into the air storage container, so that the air pressure of the compressed air being transferred to an object, such as a tire, may be too high. In addition, the motion resistance of the piston body will increase sharply at TDC, so that the reciprocating motion of the piston body will be affected. Therefore, the performance of compressing air will be lowered.

In view of the foregoing, there is a need to provide an improved air compressor which can mitigate the defects of conventional air compressors.

SUMMARY OF THE INVENTION

One object of the present invention is to provide an improved air compressor, which includes a cylinder fitted with a piston body, an air storage container made separately from the cylinder, a motor, and a main frame for mounting the motor, wherein the air storage container can be detachably mounted to the cylinder to define a primary air chamber and an auxiliary air chamber for reducing the motion resistance of the piston body.

One feature of the present invention is that cylinder is formed integrally with the main frame. The cylinder is formed with a tubular connection portion on its top wall. The tubular connection portion defines therein a central hole communicating with the inner space of the cylinder. The central hole of the tubular connection portion serves as the auxiliary air chamber for storing additional compressed air.

Another feature of the present invention is that the open bottom of the cylinder is divided into two halves according to a central vertical line of the cylinder, wherein one half of the open bottom is horizontal while the other half of the open bottom is slanted and parallel to the top surface of the head of the piston body when the piston body reaches the bottom dead center.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
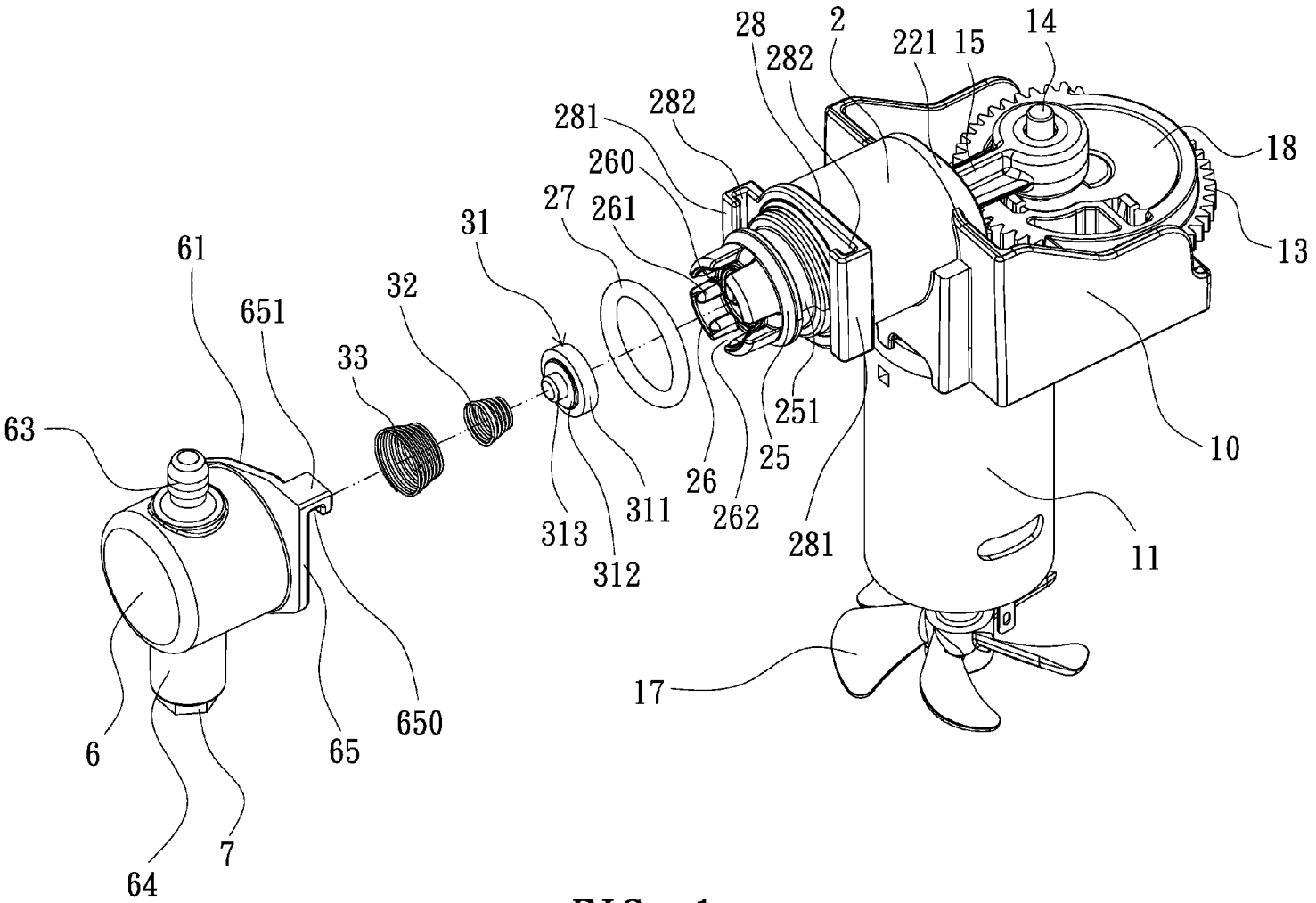
FIG. 1 shows an exploded view of an improved air compressor according to one embodiment of the present invention.

Referring to FIGS. 1 through 5, an improved air compressor according to one embodiment of the present invention is shown, which generally includes a main frame 10, a motor 11, a cylinder 2 fitted with a piston body 15, and a transmission mechanism including a pinion 12, and a gear 13 engaged with the pinion 12. The main frame 10, which mounts the motor 11, is formed integrally with the cylinder 2. The gear 13 is attached with a counterweight 18 provided with a crankpin 14. The motor 11 is provided with a cooling fan 17 at an output shaft thereof. The motor 11 can drive the transmission mechanism to have the piston 15 conduct reciprocating motion along an inner surface 20 of the cylinder 2 to produce compressed air in an inner space 23 of the cylinder 2, which can overcome the urging force of compression springs 32, 33 to move a plug 31 up (the details will be described in the following paragraphs), so that the compressed air in the inner space 23 of the cylinder 2 can be transferred to an air storage container 6 provided with a plurality of outlets 63, 64, wherein the outlet 63 can be connected with a hose (not shown), and the outlet 64 can be connected with a safety valve 7.

Figure 3:
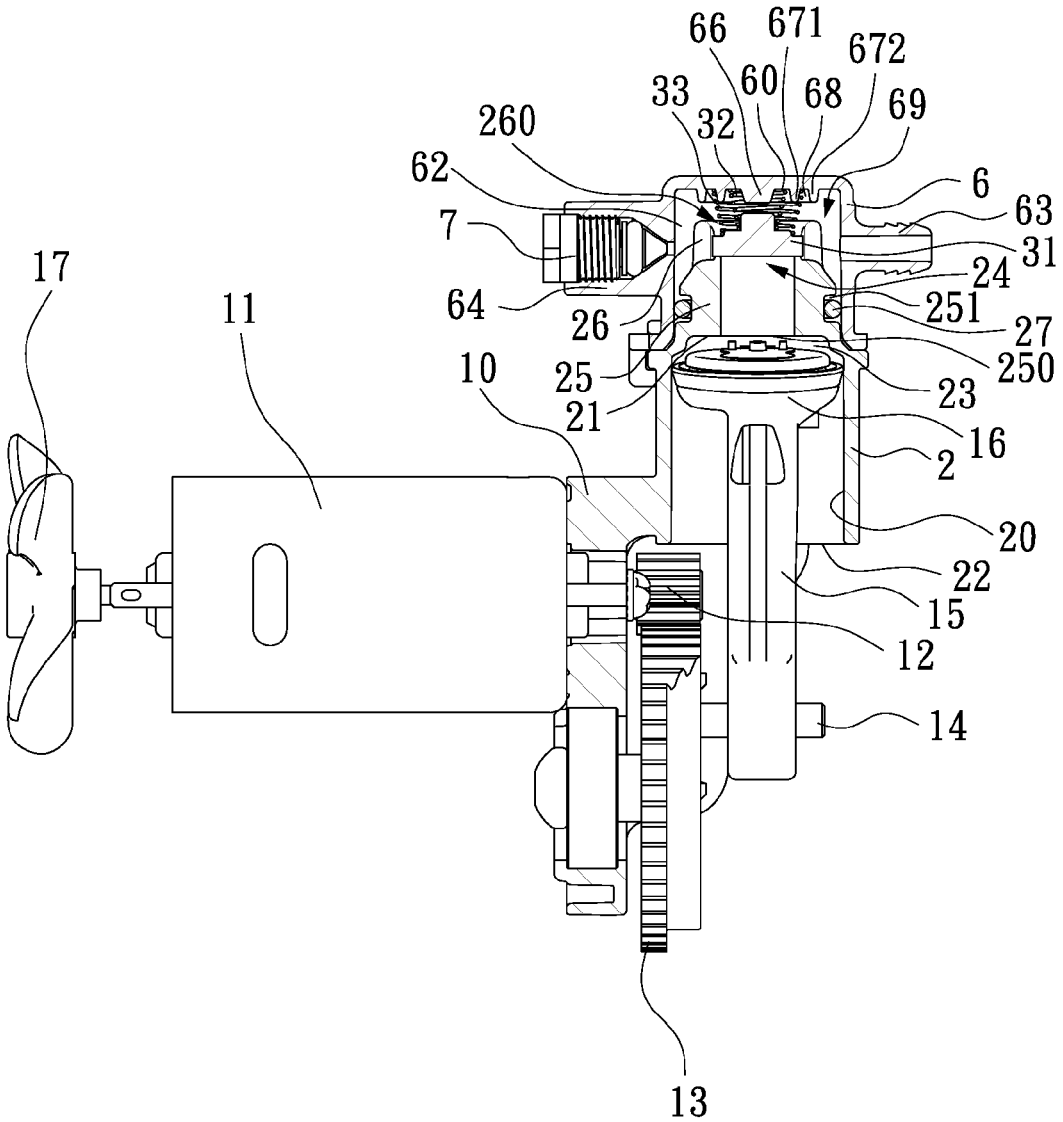
FIG. 3 shows a sectional view of the improved air compressor of the embodiment of the present invention.
Figure 5:
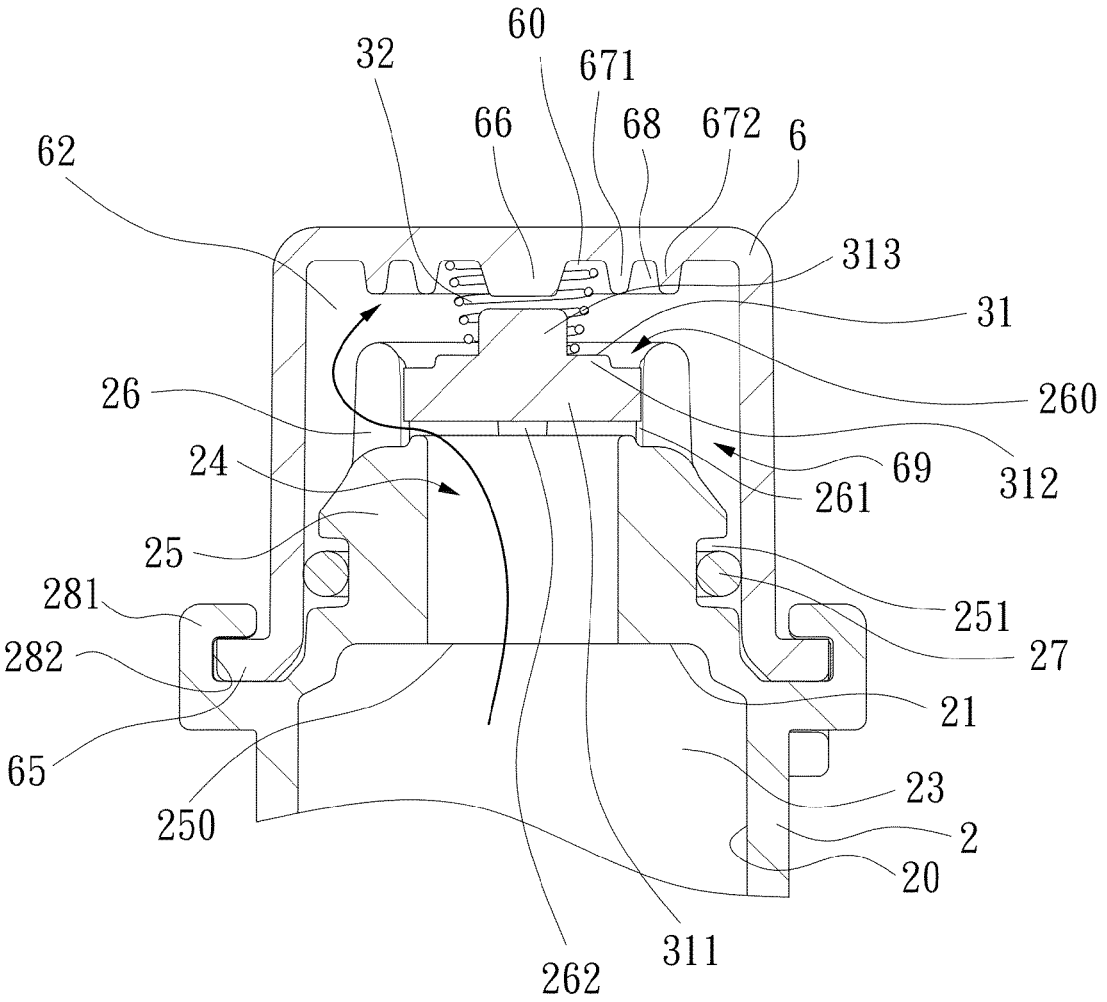
FIG. 5 shows an enlarged, partially sectional view of the improved air compressor of the embodiment of the present invention.

The cylinder 2 has a top wall 21 and an open bottom 22 opposite to the top wall 21. The cylinder 2 is provided at its surrounding wall, near its top wall 21, with a coupling flange having two opposite sides 28, each of which is provided with an L-shaped holder 281 defining a recess 282. A tubular connection portion 25 is provided on the top wall 21 of the cylinder 2. The tubular connection portion 25 defines at its outer surface an annular groove 251 to be fitted with a seal ring 27. The tubular connection portion 25 defines therein a central hole 250, extending through the top wall 21, so that the central hole 250 communicates with the inner space 23 of the cylinder 2. A plurality of tabs 26 is formed on the top of the tubular connection portion 25. The tabs 26 are arranged in a ring at regular gaps 262 therebetween, wherein each tab 26 is provided with spaced ribs 261 on its inner surface (see FIG. 1). The plug 31, which has three coaxially aligned portions including a top round portion 313, a middle round portion 312 and a bottom round portion 311, is fitted into a central space 260 surrounded by the tabs 26 and limited by the spaced ribs 261 of the tabs 26, so that the plug 31 may not move sideways. As shown in FIGS. 3 and 5, one or two compression springs 32, 33 can be provided in the air storage container 6 to force the plug 31 to seal the central hole 250 of the tubular connection portion 25 when the air pressure in the cylinder 2 is less than a predetermined pressure, wherein one end of the small compression spring 32 can be fitted around the top round portion 313 of the plug 31 and urged against the middle round portion 312 of the plug 31; one end of the large compression spring 33 can be fitted around the middle round portion 312 of the plug 31 and urged against the bottom round portion 311 of the plug 31. The diameter of the bottom round portion 311 of the plug 31 is more than the diameter of the exit hole 250 but less than the diameter of the central space 260 surrounded by the tabs 26. The compressed air produced in the inner space 23 of the cylinder 2 can flow into an inner space 62 of the air storage container 6 via the gaps 262 between the tabs 26. The inner space 62 of the air storage container 6 serves as a primary air chamber 69 for storing compressed air sent from the cylinder 2, while the space of the exit hole 250 serves as an auxiliary air chamber 24 for storing additional compressed air. The length of the exit hole 250 is greater than the permissible displacement of the plug 31 being away from the tubular connection portion 25, so that the auxiliary air chamber 24 can serve as an effective chamber for storing additional compressed air.

Figure 4:
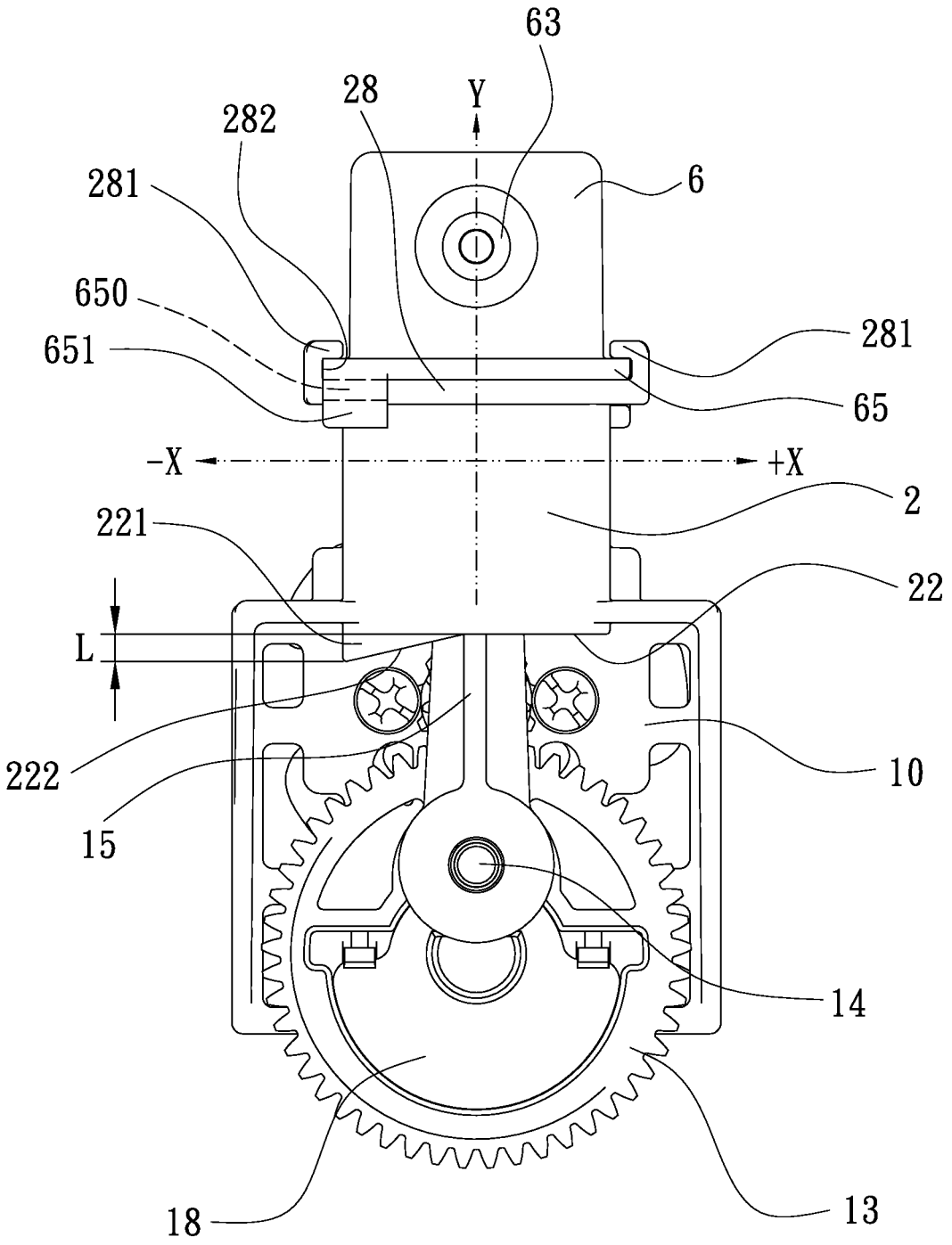
FIG. 4 shows a front view of the improved air compressor of the embodiment of the present invention.

Referring to FIG. 4, a vertical central line (Y) of the cylinder 2 is used to divide a horizontal line (X) into a positive segment (+X) and a negative segment (−X). As shown, the open bottom 22 of the cylinder 2 is divided into two halves by using the vertical central line (Y) as a dividing line, wherein one half of the open bottom 22 corresponding to the positive segment (+X) is horizontal and parallel to the plane (X-Z) (where Z is an axis perpendicular to both the X-axis and Y-axis), while the other half of the open bottom 22 corresponding to the negative segment (−X) is slanted, and thus an extension portion 221 of the surrounding wall of the cylinder 2, with a slanted bottom 222, is formed. Preferably, the slanted bottom 222 is parallel to the top surface of the head 16 of the piston body 15 when the piston body 15 is at BDC (bottom dead center) or TDC (top dead center). As shown in FIG. 4, the distance between the lowest point of the slanted bottom 222 and the horizontal bottom is indicated by the symbol (L).

The air storage container 6, which is made separately from the cylinder 2, has a closed top, a surrounding wall extending from the closed top to define the inner space 62 that terminates at an open bottom 61. The air storage container 6 is provided at its surrounding wall, near the open bottom 61, with a coupling flange having two opposite sides 65, each of which is provided with an L-shaped hook 651 defining a recess 650. The air storage container 6 is provided at its closed top with a central column 66 extending downwardly from the inner surface of the closed top. Since the length of the central column 66 will influence the sealing speed of the plug 31, the length of the central column 66 should be configured according to the application requirements of an air compressor. Provision of a longer column allows the plug 31 to be sealed more quickly. Provision of a shorter column allows the plug 31 to be sealed more slowly. Furthermore, the inner surface of the closed top of the air storage container 6 is provided with a plurality of annular protrusions 671, 672 around the central column 66, and defines a first annular groove 60 between the central column 66 and the annular protrusion 671 and a second annular groove 68 between the annular protrusions 671, 672 for respectively receiving the other ends of the compression springs 32, 33. As shown in FIG. 3, the other end of the compression spring 32 can be fitted around the central column 60 and received in the first annular groove 60; the other end of the compressing spring 33 can be fitted around the annular protrusion 671 and received in the second annular groove 68.

Figure 2:
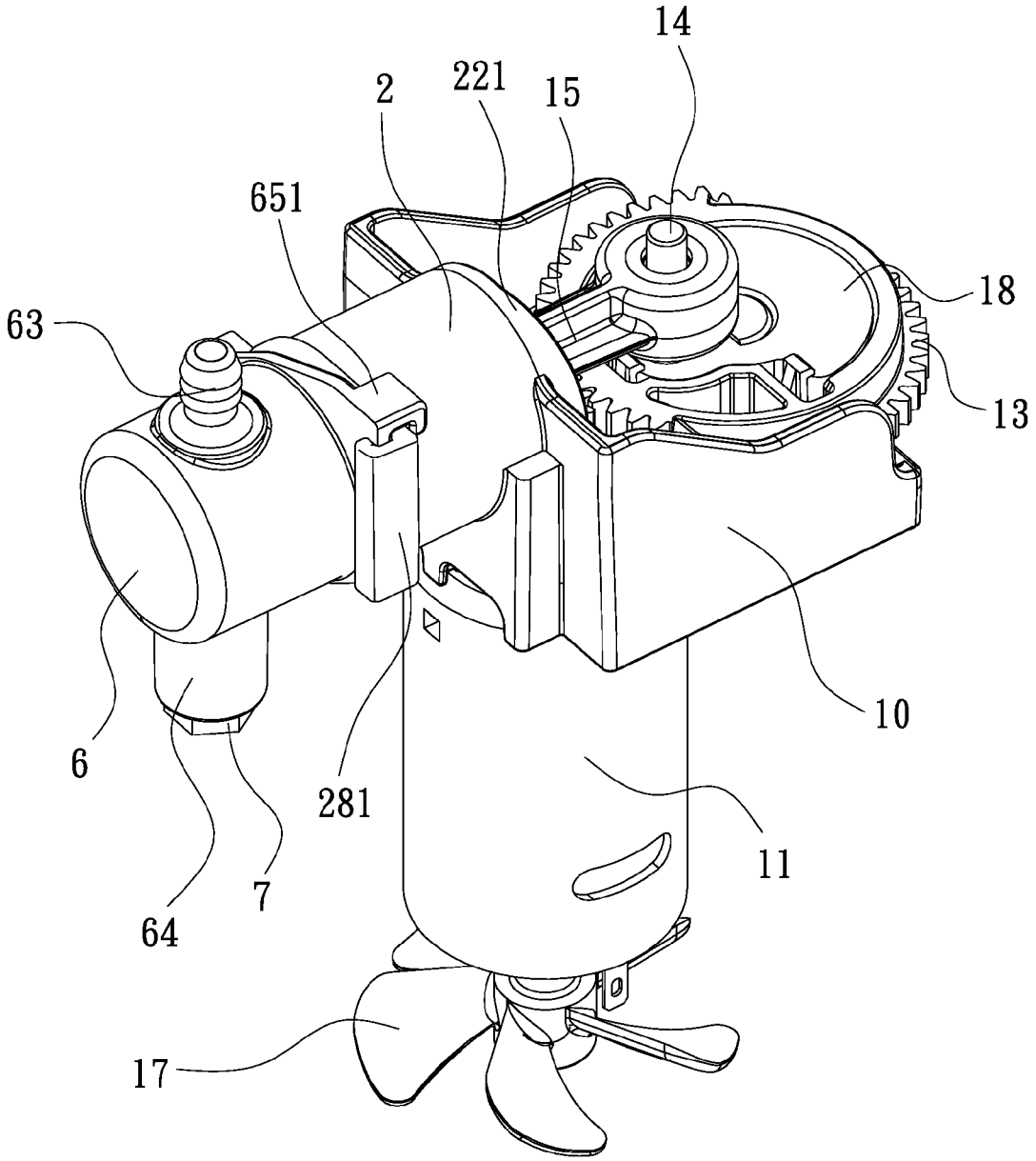
FIG. 2 shows a 3-dimensional view of the improved air compressor of the embodiment of the present invention.

As shown in FIGS. 1 and 2, the air storage container 6 can be fitted over the cylinder 2 and rotated about the cylinder 2 to have the opposite sides 65 of the coupling flange of the air storage container 6 slide in the recesses 282 of the L-shaped holder 281 of the cylinder 2 and have the opposite sides 28 of the coupling flange of the cylinder 2 slide in the recesses 650 of the L-shaped hook 651 of the air storage cylinder 6, so that the air storage container 6 is detachably mounted to the cylinder 2.

Figure 6:
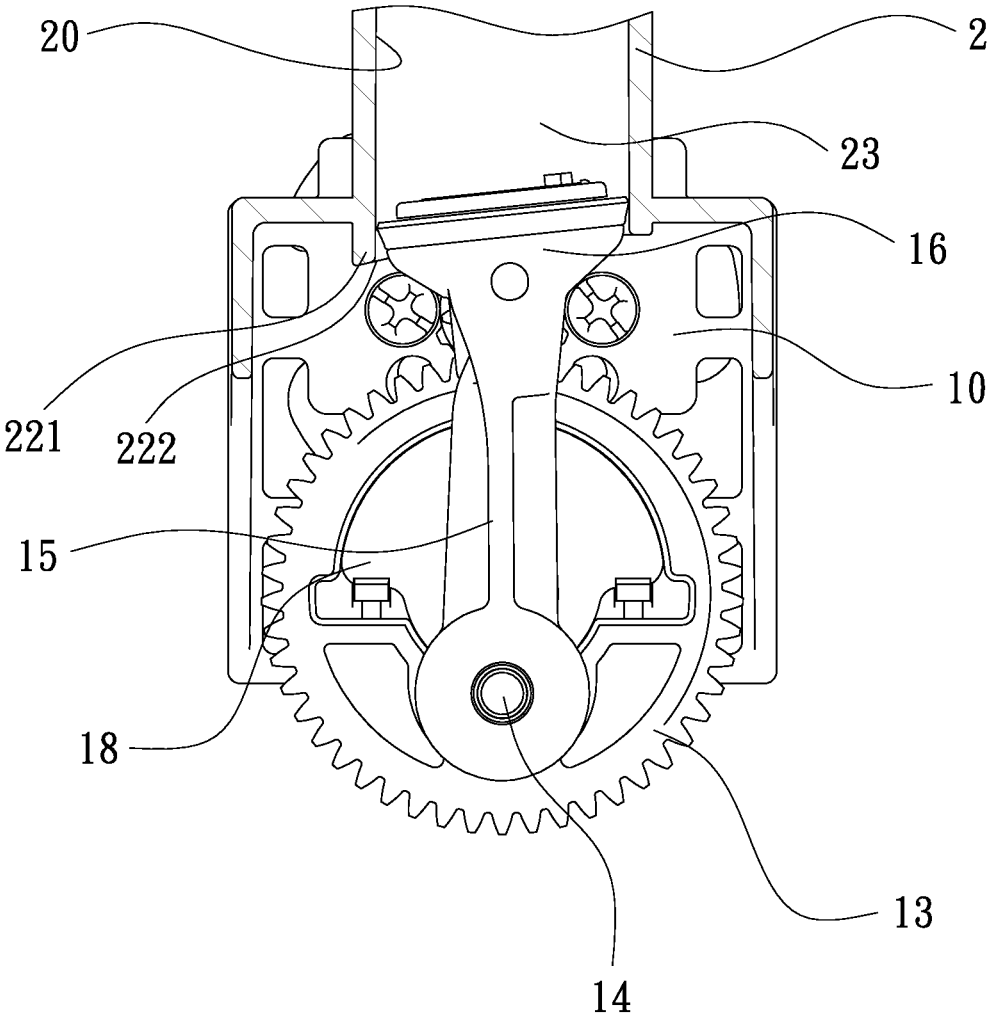
FIG. 6 shows a partially sectional view of the improved air compressor of the embodiment, wherein the piston body has conducted a downward stroke to reach the bottom dead center.

In operation, as shown in FIG. 3, the piston body 15 can be driven by the motor 11 to conduct reciprocating motion in the cylinder 2. When the piston body 15 reaches TDC (top dead center), the air in the inner space 23 of the cylinder 2 has been compressed to reach a high pressure that can overcome the urging force of the compression springs 32, 33 to move the plug 31 up and thus enter the primary air chamber 69 of the air storage container 6 via the gaps 262 between the tabs 26 (see FIG. 5). The outlet 63 can be connected by a hose (not shown) to an object to be inflated. When the piston body 15 reaches BDC (bottom dead center) (see FIG. 6), the top surface of the head 16 of the piston body 15 is parallel to the slanted surface 222 of the cylinder 2, and the head 16 of the piston body 15 is entirely within the cylinder 2 so that the piston body 15 will not escape from the cylinder 2. Therefore, the air-tightness between the head 16 of the piston body 15 and the inner surface 20 of the cylinder 2 can be maintained properly, and thus the performance of compressing air and the operational safety can be increased.

Since the central hole 250 of the tubular connection portion 25 works as an effective chamber for storing additional compressed air, when the piston body 15 approaches TDC (top dead center) (see FIG. 3), the motion resistance of the piston body 15 can be reduced. Thus, the piston body 15 can conduct reciprocating motion more smoothly. In addition, an object connected to one outlet of the air storage container 6 can be inflated properly, without exceeding the safety pressure of the object, thereby increasing the operational safety.

In light of the foregoing, the present invention provides an improved air compressor. One feature of the present invention is that the air storage container 6 is made separately from the cylinder 2 and can be detachably mounted to the cylinder 2 to define a primary air chamber 69, and an auxiliary air chamber 24 which can reduce the motion resistance of the piston body 15, so that the piston body 15 can conduct reciprocating motion more smoothly. Another feature of the present invention is that the open bottom 22 of the cylinder 2 is configured with a slanted surface 221, which can prevent the piston body 15 from escaping the cylinder 2 when the piston body 15 reaches BDC (bottom dead center), so that air-tightness between the head 16 of the piston body 15 and the inner surface 20 of the cylinder 2 can be maintained properly, thus improving the performance of compressing air and the operational safety.

I claim:

1. In an air compressor including a main frame, a motor, and a cylinder fitted with a piston body, the motor and the cylinder being provided at the main frame, the motor capable of driving the piston to conduct reciprocating motion in the cylinder to produce compressed air, which is transferred to an air storage container; wherein the improvement comprises:

the air storage container, being made separately from the cylinder, has a closed top, a surrounding wall extending from the closed top to define an inner space that terminates at an open bottom, the inner space serves as a primary air chamber for storing the compressed air produced in the cylinder; a tubular connection portion is formed on a top wall of the cylinder, the tubular connection portion defines therein an exit hole communicating with an inner space of the cylinder, the space of the exit hole serves as an auxiliary air chamber for storing additional compressed air, wherein the cylinder is provided at its surrounding wall, near its top wall, with a coupling flange having two opposite sides, each of which is provided with an L-shaped holder defining a recess; the air storage container being provided with a plurality of outlets and provided at its surround wall, near its open bottom, with a coupling flange having two opposite sides, each of which is provided with an L-shaped hook defining a recess; whereby the air storage container is capable of being fitted over the cylinder and rotated about the cylinder to have the opposite sides of the coupling flange of the air storage container slide in the recesses of the L-shaped holder of the cylinder and have the opposite sides of the coupling flange of the cylinder slide in the recesses of the L-shaped hook of the air storage cylinder, so that the air storage container is detachably mounted to the cylinder, the tubular connection portion defines at its outer surface an annular groove to be fitted with a seal ring; a plurality of tabs is formed on the top of the tubular connection portion, the tabs being arranged in a ring at regular gaps, each tab being provided with spaced ribs on its inner surface; a plug having three coaxially aligned portions including a top round portion, a middle round portion, and a bottom round portion is fitted into a central space surrounded by the tabs and limited by the spaced ribs of the tabs, so that the plug may not move sideways, a diameter of the bottom round portion of the plug being more than a diameter of the exit hole but less than a diameter of the central space surrounded by the tabs, the compressed air produced in the inner space of the cylinder being able to flow into the inner space of the air storage container via the gaps between the tabs; one or more compression springs are provided in the air storage container to force the plug to seal the exit hole of the tubular connection portion when the air pressure in the cylinder is less than a predetermined pressure, one end of each compression spring being fitted around the top round portion while urged against the middle round portion, or fitted around the middle portion while urged against the bottom round portion; a length of the exit hole is greater than a permissible displacement of the plug being away from the tubular connection portion, so that the auxiliary air chamber can serve as an effective chamber for storing additional compressed air, wherein an open bottom of the cylinder is divided into two halves according to a central vertical line (Y) of the cylinder, one half of the open bottom being horizontal while the other half of the open bottom being slanted and parallel to a top surface of the head of the piston body when the piston body is at bottom dead center; whereby when the piston body reaches bottom dead center, the head of the piston body will be entirely within the open bottom of the cylinder, and thus the piston body will not escape from the cylinder, so that an operational security is increased and air-tightness between the head of the piston body and the inner surface of the surrounding wall of the cylinder is maintained, thereby increasing a performance of compressing air.

2. The air compressor of claim 1, wherein the air storage container is provided at its closed top with a central column extending downwardly from the inner surface of the closed top, an inner surface of the closed top of the air storage container being provided with a plurality of annular protrusions around the central column and defining a plurality of annular grooves between the annular protrusions and the central column for receiving the other ends of the compression springs.

* * * * *